US005252250A

United States Patent [19]

Endo et al.

[11] Patent Number: 5,252,250

[45] Date of Patent: * Oct. 12, 1993

[54] ELECTRORHELOGICAL FLUIDS COMPRISING DIELECTRIC PARTICULATES DISPERSED IN A HIGHLY ELECTRICALLY INSULATING OILY MEDIUM

[75] Inventors: Shigeki Endo; Yuichi Ishino; Takayuki Maruyama; Tasuku Saito, all of Tokyo, Japan

[73] Assignee: Bridgestone Corporation, Tokyo, Japan

[ * ] Notice: The portion of the term of this patent subsequent to Feb. 11, 2009 has been disclaimed.

[21] Appl. No.: 658,709

[22] Filed: Feb. 21, 1991

[30] Foreign Application Priority Data

Feb. 21, 1990 [JP] Japan ..... 2-40668

[51] Int. Cl.[5] ..... C10M 171/00; C10M 169/04

[52] U.S. Cl. ..... 252/73; 252/78.3; 252/78.5; 252/79; 252/572

[58] Field of Search ..... 252/73, 77, 78.1, 78.3, 252/78.5, 79, 74, 572

[56] References Cited

U.S. PATENT DOCUMENTS

| | | | |
|---|---|---|---|
| 3,047,507 | 7/1962 | Winslow | 252/75 |
| 3,385,793 | 5/1968 | Klass et al. | 252/78.3 |
| 4,812,251 | 3/1989 | Stangroom | 252/572 |
| 5,087,382 | 2/1992 | Ishino et al. | 252/73 |

FOREIGN PATENT DOCUMENTS

| | | |
|---|---|---|
| 0156051 | 10/1985 | European Pat. Off. . |
| 0361106 | 4/1990 | European Pat. Off. . |
| 0445594 | 9/1991 | European Pat. Off. . |
| 64-6093 | 1/1989 | Japan . |
| 1-236291 | 9/1989 | Japan . |
| 2-142896 | 5/1990 | Japan . |

OTHER PUBLICATIONS

Matsepuro, "Structure Formation in an Electric Field and the Composition of Electrorheological Suspensions", translated from Elektroreol. Issled; Pril., Minsk, pp. 27-51, 1981.

"International Cooperation on Characterization and Nomenclature of Carbon and Graphite"; Carbon, 1975, vol. I, p. 251.

"International Committee for Characterization and Terminology of Carbon First Publication of Further 24 Tentative Definitions", Carbon (1983) 21:517-519.

"Allotropes"; The Encyclopedia of Chemistry Ed. G. L. Clark, Reynold Publishing Corp., NY, N.Y., 1960, p. 45.

*Primary Examiner*—Christine Skane

*Attorney, Agent, or Firm*—Cushman, Darby & Cushman

[57] ABSTRACT

The present invention relates to an electrorheological fluid which is capable of increasing viscosity under an application of electric potential difference.

An electrorheological fluid according to the present invention comprises dielectric particulates dispersed in a highly electrically insulating oily medium, in which the particulates are carbonaceous particulates having an atomic ratio of carbon atoms to hydrogen atoms (C/H) of 1.70-3.50 and an average particle size of from 0.01 to 100 μm, and the oily medium is an electrical insulating oil having a dielectric constant of not less than 3 and a volume resistivity of not less than $10^9$ Ω·cm.

20 Claims, 1 Drawing Sheet

ELECTRORHELOGICAL FLUIDS COMPRISING DIELECTRIC PARTICULATES DISPERSED IN A HIGHLY ELECTRICALLY INSULATING OILY MEDIUM

FIELD OF THE INVENTION

The present invention relates to an electrorheological fluid which is capable of increasing viscosity under an application of electric potential difference.

DESCRIPTION OF THE PRIOR ART

Electrorheological fluids are suspensions dispersing a finely divided dielectric solid in electrical insulating oils, and the fluid can increase swiftly and reversibly its viscosity under influence of a sufficiently high electric potential difference applied.

For the purpose of causing the viscosity change, the electric potential difference to be applied is either of direct current (D.C.) or of alternating current (A.C.), and the required amount of current flow is so little that it is possible to induce with a small electric power a wide variation of viscosity ranging from a liquid state to a solid state. Accordingly, electrorheological fluids have been studied as constituent elements of controlling apparatus or parts in clutches, valves, shock absorbers, vibrators, vibration-isolating rubbers, actuators, robot arms, dampers, etc.

As for solid particulates being one of constituent elements of electrorheological fluids, there have been known of cellulose, starch, silica gels, ion exchange resins, lithium polyacrylate, etc. which are pulverized and absorbed water from surface as disclosed in, for example, U.S. Pat. Nos. 2,417,850; 3,047,507; 3,397,147; 3,970,573; 4,129,513; JP B 60-31211 [1985] and DE A 3,427,499. As for liquids being the other constituting elements, halogenated diphenyls, butyl sebacate, hydrocarbon oils, chlorinated paraffins, silicone oils, etc. are known.

However, they are not satisfactory in practical usages, and an electrorheological fluid practically usable with excellent performance and stability has not been known.

Characteristics requested for a practically usable electrorheological fluid are a powerful electrorheological effect under a wide range of temperatures; a small consumption of electric power under an application of electric potential difference; a low viscosity after removal of an applied electric potential difference; no sedimentation of a dispersed phase; and stable maintenance of characteristics for a long term.

However, those dispersed particulates containing water to attain the enhanced electrorheological effect have a problem of large amount of electric current flowing through the particulates which results in an excessive consumption of electric power. The tendency is enhanced especially with the increase of temperature, and the upper limit of temperature at which the conventional electrorheological fluids using such dispersed phases can be used practically is said to be around 70°-80° C. When the electrorheological fluid is used at temperatures higher than the limit, a large consumption of electric power is required due to the excessive flow of electric current as well as a decreased performance and delayed response of the electrorheological effect as the time proceeds. Accordingly, it was impossible to use the electrorheological fluid as constituents operated under such high temperature circumstances.

Furthermore, the electrorheological fluids using the particulates containing water for the purpose of enhancing the electrorheological effect do not show the electrorheological effect at temperatures under 0° C., because the water freezes at temperatures under 0° C.

Thus, the hydrous electrorheological fluid which necessitates to contain water in the dispersed phase for exhibiting the electrorheological effect has essential problems of the usable temperature range and durability due to the evaporation of water, and the problems have been a reason why the fluid is not applicable practically. Accordingly, a practically usable anhydrous electrorheological fluid with no need of water for the dispersed phase has been awaited.

The mechanism of the electrorheological effect in anhydrous system is supposed that the application of an electric potential difference induces interfacial polarization due to the movement of electrons or positive holes in each particulate, the mutual attraction among the electronically polarized particulates occurs, the formation of bridges among the particulates causes the increase of yield stress as Bingham fluid, and the apparent viscosity of the fluid dispersing such particulates therein is increased.

Based on this viewpoint, the inventors of the present invention paid attention to so-called low temperature treated carbonaceous material which has a high concentration of stable radical (unpaired electron), and examined the availability for the dispersed phase of an electrorheological fluid, and developed an electrorheological fluid showing a high electrorheological effect with smaller electric power consumption in a wide range of temperatures under the application of D.C. or A.C.

An electrorheological fluid using as the dispersed phase the carbonaceous particulates is good in the resistance to heat and cold and in the durability. And a fluid using as the dispersing medium a silicone oil such as polydimethylsiloxane causes so little swelling toward rubbers as to become suitable for its application in vibration-isolating rubbers, etc. However, in order to have its applications in clutches and shock absorbers, it is requested for electrorheological fluids to exhibit effect as high as several times. Further, for obtaining an enhanced electrorheological effect with a fluid containing carbonaceous particulates as the dispersed phase, a problem remains on an increased electric power consumption due to necessity for increasing the electric conductivity The present inventors have found that, in an electrorheological fluid using carbonaceous particulates, the electrorheological effect relates to a dielectric constant of the electric insulating oil, from which the present invention is deduced.

SUMMARY OF THE INVENTION

It is an object of the present invention to provide an anhydrous electrorheological fluid exhibiting enhanced electrorheological effect under an application of D.C. or A.C. electric potential difference.

As a result of profound studies by the present inventors, the object has been achieved through an electrorheological fluid comprising dielectric particulates dispersed in a highly electrically insulating oily medium, in which the particulates are carbonaceous particulates having an atomic ratio of carbon atoms to hydrogen atoms (C/H) of 1.70–3.50 and an average particle size of from 0.01 to 100 μm, and the oily medium is an electrical insulating oil having a dielectric constant of not less than 3 and a volume resistivity of not less than $10^9$ Ω·cm.

DETAILED DESCRIPTION OF THE PREFERRED EMBODIMENTS

Figure 1:
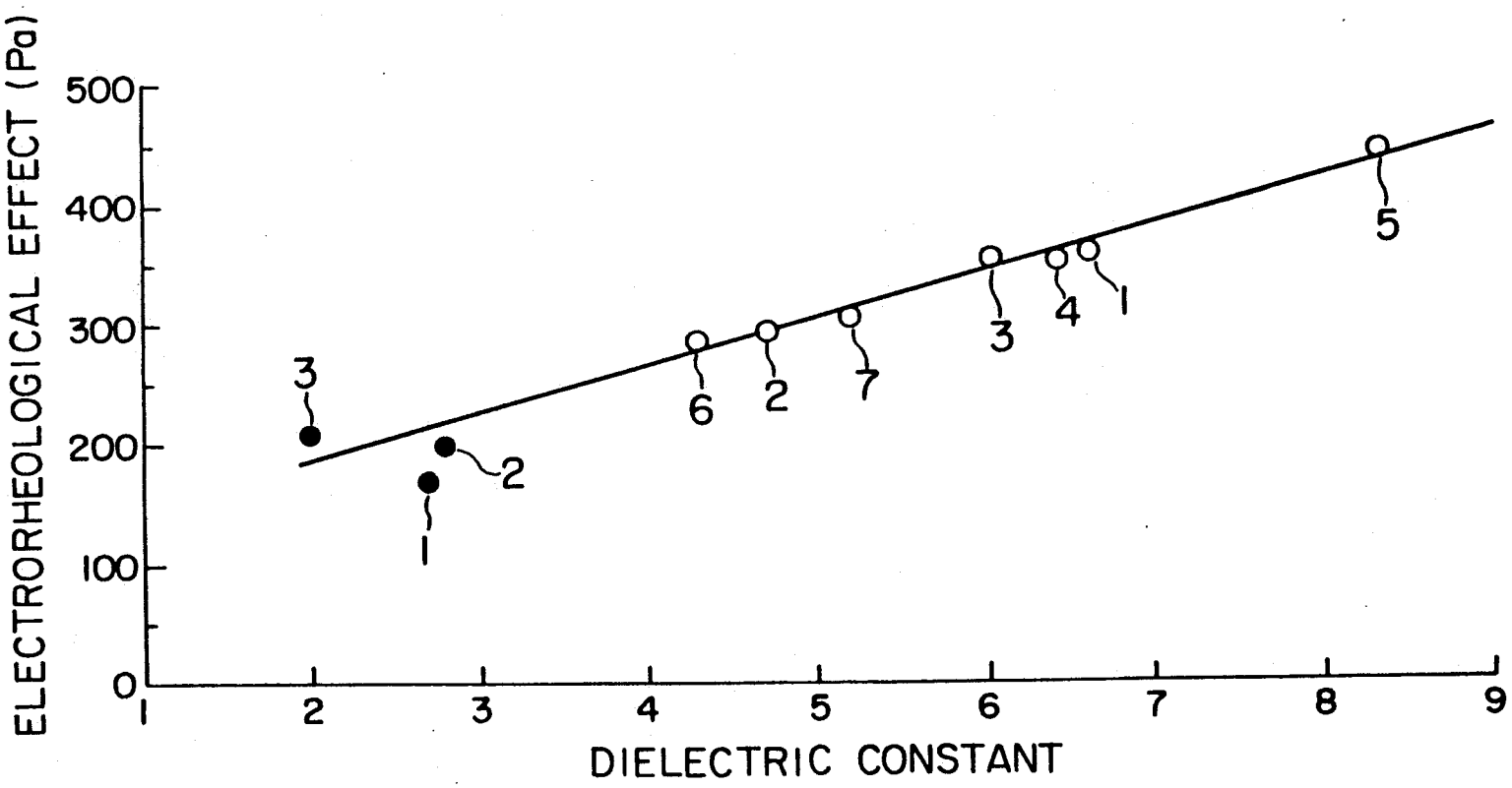
FIG. 1 shows the relationship between the dielectric constants of the electrical insulating oils and the electrorheological effects of the electrorheological fluids of Examples 1.7 and Comparative Examples 1.3.

General characteristics requested for electrorheological fluids are that, in addition to exhibiting a marked increase in viscosity under an influence of electric potential difference applied thereto with a small electric current consumption, particulates do not precipitate in the oily medium, being stable against a long term usage and temperature changes, and superior in responding to the electric potential difference applied thereto.

In order to satisfy the characteristics of electrorheological fluids, studies were conducted on carbonaceous particulates capable of meeting the request to result in a finding that an atomic ratio of carbon atoms to hydrogen atoms based on an elemental analysis (C/H) of 1.70–3.50, preferably 2.00–3.50 and more preferably 2.20–3.00 is an important factor. That is, when the C/H ratio is smaller than 1.70, the carbonaceous particulates are unable to perform as dielectric particulates suitable for electrorheological fluids and the electrorheological effect obtained are insufficient. On the other hand, when the C/H ratio is larger than 3.50, too much current flows through the electrorheological fluid to cause practically a lowered energy efficiency.

Carbonaceous particulates having the above mentioned C/H ratio suitable as a dispersed phase of electrorheological fluids are exemplified by so-called low temperature treated carbonaceous particulates or particulates of carbon precursors including; particulates composed of various carbonaceous mesophases obtained by heat treatment of coal tar pitch, petroleum pitch, pitch obtained by thermal decomposition of polyvinylchloride or the tar components, that is, particulates obtained by a solvent removal of pitch component from the pitch containing optically anisotropic spherules (mesophase spherules) obtained by the above-mentioned heat treatment, and further heat treatment; particulates obtained by pulverization of the above-mentioned various carbonaceous mesophase spherules; bulk-mesophases (c.f. JP A 30887/84) obtained by a thermal treatment of raw pitches; finely pulverized partially crystallized pitch; pulverized particulates obtained by an oxidation and further heat treatment of raw pitches; carbonaceous particulates obtained by heat-treating polymer having a high carbon content after carbonization, such as phenol resins, at 300°–800° C.; finely pulverized thermally treated coal like anthracite and bituminous coal; and pyrolized products of polyacrylonitrile. In addition to the above, carbonaceous particulates obtained by heating under pressure a mixture of vinylhydrocarbon polymer like polyethylene, polypropylene, polystyrene, etc. and chlorine containing polymer like polyvinylchloride, polyvinylydenechloride, etc.; or finely pulverized products thereof.

Among the above, carbonaceous particulates having a carbon content of 80–97%, a high aromatic radical content of above $10^{18}$/g and a high volume resistivity of above $10^5$ Ω·cm are preferred from a viewpoint of achieving high electrorheological effect with a low electric power consumption.

From this standpoint, the carbonaceous particulates obtained by heat treatment of coal tar pitch to produce optically anisotropic spherules (mesophase spherules) followed by removing pitch component therefrom are most preferable among the above-mentioned carbonaceous particulates.

An outlined process for preparing such carbonaceous particulates from coal tar pitch is described hereunder. Coal tar pitch is heat-treated at 350°–500° C. to allow optically anisotropic spherules of spherical shapes (mesophase spherules) come to grow [(J. D. Brooks and G. H. Taylor; Carbon 3, 185 (1965)]. Since the size of mesophase spherule depends on the heating temperature and length of heating time, terminate the heating at a stage when the mesophase spherule grows to a size desired. The mesophase spherule is separated therefrom by dissolving remained coal tar pitch with a solvent and filtering off.

The mesophase spherule has a structure similar to liquid crystal, and is a spherical carbonaceous particulate. A part of coal tar pitch component (e.g. β-resin), which vaporizs at the temperature of 400°–600° C. in an inert gas, tends to remain on the surface of mesophase spherule when it is separated as described in JP A 60-25364, but the pitch component can be removed, if necessary, by heat-treating it at 200°–600° C. under an inert gas atmosphere, which improves the electric resistance and aromatic spin radical concentration of the mesophase spherule.

The particle size of mesophase spherule is controlled by adjusting the length of heating time and heating temperature of the coal tar pitch, and the size can be reduced by pulverization.

As to the raw material other than coal tar pitch, petroleum pitches having similar structures can be treated in the same manner to produce carbonaceous particulates suitable for usage in the present invention.

As a result of further study by the present inventors and others as described in JP A 2-175432 (1990), it was found that carbonaceous particulates containing essentially no free carbon prepared by removing beforehand free carbon (isolated carbon) contained originally in coal tar pitch used as the raw material are especially effective for depressing a value of current flowing through an electrorheological fluid under application of an electric potential difference and reducing the electric power consumption.

That is, carbonaceous particulates essentially containing no free carbon is preferable for the present invention. The free carbon content in carbonaceous particulates is preferably not more than 10 weight % and more preferably not more than 5 weight %. An electrorheological fluid comprising carbonaceous particulates containing free carbon of above 10 weight % is not preferred practically due to a lowered energy efficiency caused by an excessive current flow.

Free carbon contained in tar or pitch is fine particles of amorphous highly carbonized carbon and is said to be formed during the vapor-phase thermal decomposition at above 1000° C. of tar generated in coal oven. Usually, free carbon is optically isotropic fine carbonaceous particulates having a particle size of below 2 μm, and is determined as QI (quinoline insoluble component) in tar. Accordingly, when the highly carbonized free carbon is contained in carbonaceous particulates, it not only brings about heterogenity in general but also an excessive current flow in electrorheological fluid to make expected electrorheological effect unattainable.

Water content of the thus obtained carbonaceous particulates is 1 weight % at the most, and the water content has almost no relationship with electrorheological effect.

It is supposed that the high aromatic spin radical concentration of the carbonaceous particulates induces interfacial polarization of the particulates to give the electrorheological effect. Accordingly, using such carbonaceous particulates as the dispersed phase, an electrorheological fluid exhibiting a high electrorheological effect in a wide temperature range for a long period of time can be obtained.

It is supposed that the carbonaceous particulates composed of the above-mentioned spherule show anisotropy in the electric conductivity due to the optical anisotropy, which is reasoned to lower the electric power consumption of electrorheological fluid using the particulates as dispersed phase.

Electric conductivity of the carbonaceous particulates can be varied in accordance with changes in the C/H ratio caused by altered calcining temperatures. Electrorheological effect will be intensified with a higher C/H ratio, which brings about an increased electric power consumption. Accordingly, it is necessary to set electric resistance of the carbonaceous particulates at an optimum point in consideration of the power consumption and electrorheological effect. In view of the above, the most preferable electric resistance of carbonaceous particulates is in the range of $10^7$–$10^{10}$ Ω·cm.

Furthermore, the present inventors have found it effective, for the purpose of lowering the electric power consumption under keeping moderate electrorheological effect, that a part of or the entire surface of the carbonaceous particulate is covered with an electrical insulating thin layer. The method is especially effective for carbonaceous particulates having a higher C/H ratio and carbon content.

As for the electrical insulating thin layer, any organic or inorganic film may be applicable if it is formed on the surface of particulates with an average thickness of less than 1/10 of the particulate diameter, though the optimum thickness depends on electric conductivity of the particulate. For particulates of higher conductivity, a relatively thick layer is preferable, and on the contrary, a relatively thin layer for particulates of lower conductivity is requested to obtain a higher electrorheological effect and a lower current flow under an application of electric potential difference.

The electrical insulating thin layer may coat the entire or a part of the surface of carbonaceous particulates.

The electrical insulating thin layers are formed by means of such methods as coating on the surface of particulates with a solution of polymer; hybridization method in which micro particles of an electrical insulating material are mixed with the carbonaceous particulates by dry method and melted on the surface of the carbonaceous particulates; vacuum deposition by sputtering; plasma treatment; and polymerization of a monomer on the surface of carbonaceous particulates. Employable electrical insulating materials exemplified are synthetic high polymers like polymethylmethacrylate, polystyrene, polyvinylacetate, polyvinylchloride, polyvinylidenefluoride, epoxy resins, phenol resins, and those polymers modified at the end of polymer chain by reactive function groups such as isocyanate group; silane coupling agents like methyltrimethoxysilane, phenyltrimethoxysilane, hexamethyldisilazane and trimethylchlorosilane; modified silicone polymers or silicone surfactants having principal chains of dimethylpolysioxane or phenylmethylpolysiloxane structures with carboxyl groups or hydroxyl groups; and inorganic compounds like silica, alumina and rutile.

In some cases, the electrical insulating thin layer is physically adsorbed on the surface of carbonaceous particulates. However, an electrical insulating thin layer being reacted with functional groups or radicals on the surface of carbonaceous particulates is more durable against the electric discharge. In this sense, for example, vinyl polymers modified with reactive functional groups such as isocyanate group are preferred materials for the electrical insulating thin layer.

By the use of thus prepared carbonaceous particulates coated with an electrical insulating thin layer as a dispersed phase of an electrorheological fluid, it is possible to obtain an electrorheological fluid exhibiting superior electrorheological effect with a reduced power consumption.

The particle size suitable for a dispersed phase of an electrorheological fluid is 0.01–100 μm, preferably 0.1–20 μm, and more preferably 0.5–20 μm, and a sharp particle size distribution is preferred. The particle size of less than 0.01 μm makes the initial viscosity of electrorheological fluid without application of a electric potential difference too high to result in smaller change in viscosity by electrorheological effect, and that of larger than 100 μm cannot provide a dispersed phase sufficiently stable for an electrorheological fluid.

The present inventors have found as a result of study on various electrical insulating oils by the use of these carbonaceous particulates as the dispersed phase that dielectric constant of an electrical insulating oil affects markedly on the electrorheological effect, and that a higher electrorheological effect under application of D.C. and A.C. electric potential difference is achieved when an electrical insulating oil having an dielectric constant of larger than 3, preferably 4–30 and more preferably 5–15, is used as a dispersing medium.

Electrical insulating oils having dielectric constant of larger than 3 are exemplified by fluorosilicone oils, halogenated saturated hydrocarbon oils, halogenated aromatic oils, ester oils including monobasic acid esters, dibasic acid esters, tribasic acid esters, polyolesters, phosphoric acid esters, halogenated aromatic monocarboxylic acid esters, halogenated aromatic dicarboxylic acid esters, halogenated tricaboxylic acid esters and their mixture. Respective oils will be described in detail hereinafter.

As to fluorosilicone oils, they are represented by the formula $$[R^f_m R_n SiO_{(4-m-n)/2}]\times$$

wherein $R^f$ is a saturated fluoroalkyl group having 1–13 carbon atoms. The fluoroalkyl group $R^f$ is selected, for example, from 3, 3,3-trifluoropropyl group, 3,3,4,4,5,5,5-heptafluoropentyl group, and 3,3,4,4,5,5,6,6,7,7,8,8,9,9,10,10,10-heptadecafluorodecyl group. Among these groups, 3,3,3-trifluoropropyl group is preferred. R is a substituted or non-substituted hydrocarbon group having 1–6 carbon atoms. The hydrocarbon group R is selected, for example, from methyl group, ethyl group, propyl group, butyl group; cycloalkyl groups like cyclohexyl group; and phenyl group; and methyl group is preferred among them. In the above formula, m, n, and x are numbers for specifying the structure of fluorosilicone oil by satisfying the following relationships; $1.5<m+n<2.5$, $0.05<m/n\leqq 1$, and $3\leqq x$; preferably $1.9<m+n<2.2$, $0.2<m/n\leqq 1$, and $5\leqq x$; and they are so selected as the desired viscosity and dielectric constant are available.

For the ester oils, mentions are made, for example, as monoesters, diesters and triesters which are esters of acids including aliphatic monocarboxylic acids like neocapric acid; aromatic monocarboxylic acids like benzoic acid and their halogenides such as fluoride, chloride and bromide; aliphatic dicarboxilic acids like adipic acid, glutaric acid, sebacic acid, azelaic acid; aromatic dicarboxylic acids like phthalic acid, isophthalic acid, tetrahydrophthalic acid or their halogenides; aliphatic tricarboxylic acids like citric acid; and aromatic tricarboxylic acids like trimellitic acid or halogenides; with alcohols including aliphatic alcohols like methyl alcohol, ethyl alcohol, butyl alcohol, 2-ethyhexyl alcohol, octyl alcohol, isooctyl alcohol, isobutyl alcohol, heptyl alcohol, isodecyl alcohol, hexyl alcohol, decyl alcohol, undecyl alcohol; and aromatic alcohols like benzyl alcohol. For phosphoric acid esters, mentions are made, for example, as trimethyl phosphate, triethyl phosphate, tributyl phosphate, tri (2-ethylhexyl) phosphate, 2-ethylhexyl diphenyl phosphate, triphenyl phosphate, tricresyl phosphate, cresyldiphenyl phosphate, isodecyldiphenyl phosphate, trixylenyl phosphate and xylenyldiphenyl phosphate.

As for polyolesters, esters of polyalcohols like pentaerythritol, polyethyleneglycol, polypropyleneglycol and glycerin with higher fatty acids are mentioned.

As for halogenated hydrocarbons, chlorinated paraffins having varied degrees of chlorination and halogenated aromatic hydrocarbons like tertachlorotriphenylmethane, trichlorodiphenyl ether, trichlorodiphenylmethane are mentioned.

Among the above, fluorosilicone oils are preferred most from viewpoints of the superior electrical insulation and higher specific gravity.

Volume resistivities of electrical insulating oils for electrorheological fluids are set at higher than $10^9$ Ω·cm at 25° C., preferably higher than $10^{11}$ Ω·cm, and more preferably higher than $10^{12}$ Ω·cm. When the value is below $10^9$ Ω·cm, the current flow under an application of electric potential difference increases markedly and the energy efficiency for application device is lowered.

Electrorheological fluids according to the present invention are usable basically with an application of D.C. and A.C. electric potential difference, however, coagulation of particles on one side electrode due to the electrophoresis may sometimes occur depending on the electrification conditions of particles. Under such situations, it is recommended to apply A.C. electric potential difference for altering frequently the cathode and anode.

For the purpose of obtaining oils of improved electrical insulation, an oil having a high dielectric constant may be mixed with an oil having a low dielectric constant but having a high electrical resistance, and the latter includes silicone oils having principal chains of polydimethylsilioxane or polymethylphenylsiloxane, mineral oils and fluorinated oils like perfluoropolyether, polytrifluorochloroethylene, and their mixture, etc. In the mixing, it is necessary to make a mixed oil has a dielectric constant of not less than 3, and cause no incompatibility. Mixtures of fluorinated oil and fluorosilicone oil are preferred for obtaining oils having densities near those of carbonaceous particulates with higher dielectric constants and higher volume resistivities. The smaller difference in densities of carbonaceous particulates and oils contributes the stability of electrorheological fluids for a long period of time.

As for viscosities of electrical insulating oils, they are set at 0.65–1000 cSt (centi-stokes), preferably 5–200 cSt and more preferably 10–50 cSt at 25° C. A too low viscosity makes the liquid phase contain too much volatile matters and worsens its stability, and a too high viscosity brings about a high initial viscosity under no application of electric potential difference to result in a decreased viscosity change due to the electrorheological effect. A dispersed phase can be suspended efficiently by the use of an electrical insulating oil having an appropriately low viscosity.

In the present invention, a dispersed phase and a liquid phase constituting an electrorheological fluid have a proportion for the former composed of carbonaceous particulates mentioned previously of 1–60 weight % and preferably 20–50 weight %, and for the latter composed of an electrical insulating oil mentioned previously of 99–40 weight % and preferably 80–50 weight %. A dispersed phase of less than 1 weight % exhibits smaller electrorheological effect and that of larger than 60 weight % shows a marked large initial viscosity under no application of electric potential difference.

Into electrorheological fluids according to the present invention, additives like other dispersed phases, surfactants, dispersing agents, antioxidants, etc. may be incorporated so far as effect of the present invention are not diminished markedly.

The present invention will be described concretely hereunder with reference to non-limitative examples.

EXAMPLE 1

Heat treatment at 450° C. in a 20 liter autoclave under substantially inert atmosphere was conducted for coal tar containing no free carbon. The heat-treated material was subjected to extraction-filtration using a tar middle oil (boiling point range of 120°–250° C.), and the residue thereof was again heat-treated at 500° C. under 2.0 liter/min nitrogen gas flow using a batch type rotary reactor of 2 liter capacity to obtain carbonaceous particulates having C/H ratio of 2.38. The particulates were pulverized and classified with a pneumatic classifier to have an average particle size of 3.8 μm.

An electrorheological fluid was prepared by dispersing 20 volume % of the carbonaceous particulates into 80 volume % of a fluorosilicone oil having kinematic viscosity at room temperature of 86 cSt; specific gravity (Sp.G.) of 1.216; dielectric constant of 6.6; and volume resistivity of $6.31\times10^{11}$ Ω·cm.

The measurement of electrorheological effect was conducted with a double-cylinders type rotary viscometer measuring the increase in shearing stress ($\Delta\tau$) at shearing speed of 366 $sec^{-1}$ under an application of 2 KV/mm effective A.C. electric potential difference between the outer and inner cylinders. The electrorheological effect ($\Delta\tau$) was 359.6 Pa. Similar electrorheological effect were obtained under an application of D.C. electric potential difference.

EXAMPLE 2

An electrorheological fluid was prepared by dispersing 20 volume % of the same carbonaceous particulates as those used in Example 1 into 80 volume % of a fluorosilicone oil having kinematic viscosity at room temperature of 22 cSt; Sp.G. of 1.067; dielectric constant of 4.7; and volume resistivity of $5.01\times10^{11}$ Ω·cm. The electrorheological effect was measured in the same manner as Example 1 to obtain Δτ of 296.2 Pa. Similar electrorheological effect were obtained under an application of D.C. electric potential difference.

EXAMPLE 3

An electrorheological fluid was prepared by dispersing 20 volume % of the same carbonaceous particulates as those used in Example 1 into 80 volume % of a fluorosilicone oil having kinematic viscosity at room temperature of 55.5 cSt; Sp.G. of 1.149; dielectric constant of 6.0; and volume resistivity of $3.98\times10^{11}$ Ω·cm. The electrorheological effect was measured in the same manner as Example 1 to obtain Δτ of 352.5 Pa. Similar electrorheological effect were obtained under an application of D.C. electric potential difference.

EXAMPLE 4

An electrorheological fluid was prepared by dispersing 20 volume % of the same carbonaceous particulates as those used in Example 1 into 80 volume % of a fluorosilicone oil having kinematic viscosity at room temperature of 33 cSt; Sp.G. of 1.186; dielectric constant of 6.4; and volume resistivity of $7.94\times10^{10}$ Ω·cm. The electrorheological effect was measured in the same manner as Example 1 to obtain Δτ of 345.7 Pa. Similar electrorheological effect were obtained under an application of D.C. electric potential difference.

Fluorosilicone oils used in Example 1–4 were polytrifluoropropylmethylsiloxane or a copolymer of polytrifluoropropylmethylsiloxane and polydimethylsiloxane.

EXAMPLE 5

An electrorheological fluid was prepared by dispersing 20 volume % of the same carbonaceous particulates as those used in Example 1 into 80 volume % of chlorinated paraffin having kinematic viscosity at room temperature of 122 cSt; Sp.G. of 1.165; dielectric constant of 8.3; and volume resistivity of $1.11\times10^{11}$ Ω·cm. The electrorheological effect was measured in the same manner as Example 1 to obtain Δτof 446.4 Pa. Similar electrorheological effect were obtained under an application of D.C. electric potential difference.

EXAMPLE 6

An electrorheological fluid was prepared by dispersing 20 volume % of the same carbonaceous particulates as those used in Example 1 into 80 volume % of trioctyl trimellitate having dynamic viscosity at room temperature of 220 cSt; Sp.G. of 0.97; dielectric constant of 4.3; and volume resistivity of $5.71\times10^{11}$ Ω·cm. The electrorheological effect was measured in the same manner as Example 1 to obtain Δτ of 288.6 Pa. Similar electrorheological effect were obtained under an application of D.C. electric potential difference.

EXAMPLE 7

An electrorheological fluid was prepared by dispersing 20 volume % of the same carbonaceous particulates as those used in Example 1 into 80 volume % of di-(2-ethylhexyl) phthalate having kinematic viscosity at room temperature of 41 cSt; Sp.G. of 0.986; dielectric constant of 5.2; and volume resistivity $8.64\times10^{11}$ Ω·cm. The electrorheological effect was measured in the same manner as Example 1 to obtain Δτ of 305.4 Pa. Similar electrorheological effect were obtained under an application of D.C. electric potential difference.

EXAMPLE 8

Heat treatment at 450° C. under substantially inert atmosphere was conducted for coal tar containing no free carbon to form mesophase spherules. The heat-treated material was subjected to repeated extraction-filtration using a tar middle oil, and the residue thereof was again heat-treated (calcined) at 530° C. under nitrogen gas flow to obtain carbonaceous particulates having C/H ratio of 2.45. The carbonaceous particulates were pulverized with a jet mill and classified with a pneumatic classier to prepare carbonaceous particulates with an average particle size of 5.2 μm. Into 400 milliliter of 1 weight % cyclohexane solution containing a polystyrene of molecular weight 5,000–10,000 modified terminally with tolylenediisocyanate was added 100 grams of the carbonaceous particulates, and the mixture was agitated for 2 hours at 70° C. Then, the polystyrene solution was separated and the residual carbonaceous particulates was dried enough to remove the solvent.

An electrorheological fluid was prepared by dispersing 20 volume % of the carbonaceous particulates coated with the polystyrene into 80 volume % of a fluorosilicone oil having kinematic viscosity at room temperature of 29 cSt; Sp.G. of 1.25; dielectric constant of 6.6; and volume resistivity of $1.1\times10^{12}$ Ω·cm. The electrorheological effect was measured in the same manner as Example 1 to obtain Δτ of 944.8 Pa. Similar electrorheological effect were obtained under an application of D.C. electric potential difference.

EXAMPLE 9

An electrorheological fluid was prepared by dispersing 20 volume % of the same carbonaceous particulates as those used in Example 1 into 80 volume % of a mixture of the fluorosilicone oil used in Example 8 and polytrifluoromonochloroethylene (mixing weight ratio was 1:0.429) having kinematic viscosity at room temperature of 20 cSt; Sp.G. of 1.40; dielectric constant of 5.7; and volume resistivity of $1.03\times10^{12}$ Ω·cm. The electrorheological effect was measured in the same manner as Example 1 to obtain Δτ of 323.7 Pa. Similar electrorheological effect were obtained under an application of D.C. electric potential difference.

COMPARATIVE EXAMPLE 1

An electrorheological fluid was prepared by dispersing 20 volume % of the same carbonaceous particulates as those used in Example 1 into 80 volume % of silicone oil (polydimethylsiloxane) having kinematic viscosity at room temperature of 20 cSt; Sp.G. of 0.95; dielectric constant of 2.7; and volume resistivity $1.98\times10^{12}$ Ω·cm. The electrorheological effect was measured in the same manner as Example 1 to obtain Δτ of 169.4 Pa.

COMPARATIVE EXAMPLE 2

An electrorheological fluid was prepared by dispersing 20 volume % of the same carbonaceous particulates as those used in Example 1 into 80 volume % of polytrifluoromonochloroethylene having kinematic viscosity at room temperature of 11 cSt; Sp.G. of 1.87; dielectric constant of 2.8; and volume resistivity $9.69\times10^{11}$ Ω·cm. The electrorheological effect was measured in the same manner as Example 1 to obtain Δτ of 200.0 Pa.

COMPARATIVE EXAMPLE 3

An electrorheological fluid was prepared by dispersing 20 volume % of the same carbonaceous particulates as those used in Example 1 into 80 volume % of perfluoropolyether having kinematic viscosity at room temperature of 54 cSt; Sp.G. of 1.86; dielectric constant of 2.0; and volume resistivity of $4.04\times10^{12}$ Ω·cm. The electrorheological effect was measured in the same manner as Example 1 to obtain $\Delta\tau$ of 209.0 Pa.

The results of Examples 1.9 and Comparative Examples 1.3 are shown in the following Table 1, in which the dielectric constant (relative dielectric constant) and volume resistivity are those measured at room temperature using the methods described in JIS-C2101.

TABLE 1

| | Electrical insulating oil | | | | Electro-rheological effect (Pa) |
|---|---|---|---|---|---|
| | Viscosity (cSt) | Dielectric constant | Volume resistivity (Ω · cm) | Sp.G. | |
| Example | | | | | |
| 1 | 86 | 6.6 | $6.31\times10^{11}$ | 1.216 | 359.6 |
| 2 | 22 | 4.7 | $5.01\times10^{11}$ | 1.067 | 296.2 |
| 3 | 55.5 | 6.0 | $3.98\times10^{11}$ | 1.149 | 352.5 |
| 4 | 33 | 6.4 | $7.94\times10^{11}$ | 1.186 | 345.7 |
| 5 | 122 | 8.3 | $1.11\times10^{11}$ | 1.165 | 446.4 |
| 6 | 220 | 4.3 | $5.71\times10^{11}$ | 0.97 | 288.6 |
| 7 | 41 | 5.2 | $8.64\times10^{11}$ | 0.986 | 305.4 |
| 8 | 29 | 6.6 | $1.1\times10^{12}$ | 1.25 | 944.8 |
| 9 | 20 | 5.7 | $1.03\times10^{12}$ | 1.40 | 323.7 |
| Comparative Example | | | | | |
| 1 | 20 | 2.7 | $1.98\times10^{12}$ | 0.95 | 169.4 |
| 2 | 11 | 2.8 | $9.69\times10^{11}$ | 1.87 | 200.0 |
| 3 | 54 | 2.0 | $4.04\times10^{12}$ | 1.86 | 209.0 |

The relationship between the dielectric constants of the electrical insulating oils and the electrorheological effects of the electrorheological fluids of Examples 1-7 and Comparative Examples 1-3 are shown in FIG. 1. In FIG. 1, the abscissa indicates the dielectric constant and the ordinate indicates the electrorheological effect ($\Delta\tau$), and white disc marks correspond to Examples and black disc marks correspond to Comparative Examples.

As is shown in Table 1 and FIG. 1, an electrorheological effect of a fluid employing an electrical insulating oil having a dielectric constant of larger than 3 illustrated in Examples 1-7 is more remarkable than that of a fluid employing an electrical insulating oil having a dielectric constant of smaller than 3 illustrated in Comparative Examples 1-3.

Further, as mentioned in Table 1, the electrorheological fluid using carbonaceous particulates coated with a polymer as the dispersed phase (Example 8) showed a considerable electrorheological effect.

Further, an oil mixed to have a dielectric constant of larger than 3 (Example 9) is effective for performing enhanced electrorheological effect.

Electrorheological fluids attained in accordance with the present invention are capable of exhibiting higher electrorheological effect under an application of D.C. or A.C. electric potential difference in comparison with conventional ones, and are superior in the high-temperature stability and long term durability.

We claim:

1. An electrorheological fluid comprising 1-60 weight % of dielectric particulates dispersed in 99-40 weight % of a highly electrically insulating oily medium, in which the particulates are carbonaceous particulates having a atomic ratio of carbon atoms to hydrogen atoms (C/H) of 1.70-3.50 and an average particle size of from 0.01 to 100 μm, and the oily medium consisting essentially of an electrical insulating oil having a dielectric constant of not less than 4 and a volume resistivity of not less than $10^9$ Ω·cm.

2. An electrorheological fluid according to claim 1, wherein said electrical insulating oil is selected from the group consisting of a fluorosilicone oil, a halogenated saturated hydrocarbonoil, a halogenated aromatic hydrocarbon oil, an ester of monobasic acid, an ester of dibasic acid, an ester of tribasic acid, a phosphoric ester, a polyolester oil, or their mixture.

3. An electrorheological fluid according to claim 1, wherein said electrical insulating oil is a mixture of a fluorosilicone oil, a halogenated saturated hydrocarbon oil, a halogenated aromatic hydrocarbon oil, an ester of monobasic acid, an ester of dibasic acid, an ester of tribasic acid, a phosphoric ester, a polyolester oil, or their mixture with a silicone oil, a mineral oil, a fluorinated oil, or their mixture.

4. An electrorheological fluid according to claim 1, 2 or 3, wherein said carbonaceous particulates are surface-coated with a thin layer of an electrical insulating material.

5. An electrorheological fluid according to claim 4, wherein said electrical insulating material is a polymer.

6. An electrorheological fluid according to claim 1, wherein carbon content of said carbonaceous particulates is in a range of 80-97 weight %.

7. An electrorheological fluid according to claim 1, wherein said carbonaceous particulates are those which are calcined at a temperature of 200°-600° C.

8. An electrorheological fluid according to claim 1, wherein said carbonaceous particulates comprise optically anisotropic spherules obtained by heat treatment of coal tar pitch or petroleum pitch at a temperature of 350°-500° C. and separated from the residual pitch component.

9. An electrorheological fluid according to claim 1, wherein said carbonaceous particulates contain free carbon of not more than 10 weight %.

10. An electrorheological fluid according to claim 2, wherein said fluorosilicone oil is represented by the formula $$[R^f_m R_n SiO_{(4-m-n)/2}]_x$$

wherein $R^f$ is a fluoroalkyl group having 1-13 carbon atoms; R is a non-substituted or substituted hydrocarbon group having 1.6 carbon atoms; and m, n, and x are numbers satisfying the following relationships; $1.5<m+n<2.5$, $0.05<m/n\leqq1$, and $3\leqq x$.

11. An electrorheological fluid according to claim 1, wherein said electrical insulating oil has viscosity of 0.65-1000 cSt at 25° C.

12. An electrorheological fluid according to claim 10, wherein said fluoroalkyl group is 3,3,3-trifluoropropyl group and hydrocarbon group is methyl group.

13. An electrorheological fluid according to claim 3, wherein said fluorinated oil is poly-trifluoromonochloroethylene.

14. An electrorheological fluid according to claim 2, wherein said monobasic acid is an aromatic monocarboxylic acid or its halogenide, said dibasic acid is an aromatic dicarboxylic acid or its halogenide, and said tribasic acid is an aromatic tricarboxylic acid or its halogenide.

15. An electrorheological fluid according to claim 4, wherein said thin layer covers partially or wholly the surface of carbonaceous particulates, and the average thickness of thin layer is one tenth or less of the average diameter of the particulates.

16. An electrorheological fluid according to claim 5, wherein said polymer is a vinylpolymer modified with a compound having isocyanate group.

17. An electrorheological fluid according to claim 17, wherein said vinylpolymer is polystyrene.

18. An electrorheological fluid according to claim 1, wherein said carbonaceous particulates have a volume resistivity of $10^5$ Ω·cm or more.

19. An electrorheological fluid according to claim 1, wherein said carbonaceous particulates are pulverized particulates.

20. The electrorheological fluid according to claim 1 wherein said fluid additionally contains minor components selected from the following: surfactants, dispersing agents, and antioxidants.

* * * * *